US008651717B2

(12) United States Patent
Naganawa

(10) Patent No.: US 8,651,717 B2
(45) Date of Patent: Feb. 18, 2014

(54) VEHICULAR ILLUMINATION LAMP

(75) Inventor: Masahito Naganawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 358 days.

(21) Appl. No.: 13/025,543

(22) Filed: Feb. 11, 2011

(65) Prior Publication Data

US 2011/0199777 A1 Aug. 18, 2011

(30) Foreign Application Priority Data

Feb. 15, 2010 (JP) ..... 2010-029910

(51) Int. Cl.
*F21S 8/10* (2006.01)

(52) U.S. Cl.
USPC ..... 362/539; 362/507; 362/296.07

(58) Field of Classification Search
USPC ..... 362/539, 507, 296.07, 311.01, 514, 362/517, 518, 520, 549
See application file for complete search history.

(56) References Cited

U.S. PATENT DOCUMENTS

| | | | | |
|---|---|---|---|---|
| 7,455,438 | B2 * | 11/2008 | Repetto et al. | 362/516 |
| 2005/0117363 | A1 | 6/2005 | Yamamura et al. | |
| 2005/0122737 | A1 | 6/2005 | Watanabe et al. | |
| 2007/0285939 | A1 | 12/2007 | Tachibana | |
| 2008/0062709 | A1 | 3/2008 | Mochizuki et al. | |

FOREIGN PATENT DOCUMENTS

| | | | |
|---|---|---|---|
| CN | 101144579 | A | 3/2008 |
| JP | 2005-166590 | A | 6/2005 |
| JP | 2007-329068 | A | 12/2007 |

OTHER PUBLICATIONS

Office Action for Chinese Application No. 201110038077.4 mailed Aug. 10, 2012, with English translation thereof (11 pages).
English abstract of JP2005166590 published on Jun. 23, 2005, espacenet database, 1 page.
English abstract of JP2007329068 published on Dec. 20, 2007, espacenet database, 1 page.

* cited by examiner

*Primary Examiner* — Sharon Payne
(74) *Attorney, Agent, or Firm* — Osha Liang LLP

(57) ABSTRACT

A lamp includes a projection lens, a light-emitting element disposed rearwardly of a rear-side focal point of the projection lens to be directed upward, a reflector disposed to cover the light-emitting element from an upper side to reflect light from the light-emitting element toward the projection lens, and a shade disposed with an upper end edge thereof passing closely below the rear-side focal point to block part of reflected light from the reflector. Generally the entirety of a portion of the projection lens positioned above the optical axis is cut away. A reflective surface that reflects downward the reflected light from the main reflector is formed on a rear surface of the shade. A sub reflector that reflects forward the reflected light from the reflector reflected by the reflective surface of the shade so as not to be incident on the projection lens is disposed below the shade.

6 Claims, 4 Drawing Sheets

VEHICULAR ILLUMINATION LAMP

BACKGROUND OF INVENTION

1. Field of the Invention

The present invention relates to a so-called projector-type vehicular illumination lamp, and, in particular, to a vehicular illumination lamp including a light-emitting element serving as a light source.

2. Related Art

In recent years, light-emitting elements such as light-emitting diodes have been put into use as light sources for vehicular illumination lamps.

For example, "Patent Document 1" describes a projector-type vehicular illumination lamp including a projection lens disposed on an optical axis extending in a vehicular longitudinal direction, a light-emitting element disposed rearwardly of a rear-side focal point of the projection lens to be directed upward, and a main reflector disposed to cover the light-emitting element from an upper side to reflect light from the light-emitting element toward the projection lens.

In the vehicular illumination lamp described in "Patent Document 1," a mirror member having an upward reflective surface extending rearward in parallel with the optical axis from the proximity of the rear-side focal point of the projection lens is provided between the main reflector and the projection lens, so that part of the reflected light from the main reflector is reflected upward by the mirror member to be incident on the projection lens and emitted forward via the projection lens. Consequently, a cut-off line of a low-beam light distribution pattern is formed as an inverted projection image of the front end edge of the upward reflective surface of the mirror member.

Meanwhile, "Patent Document 2" describes a projector-type vehicular illumination lamp in which first and second sub reflectors are disposed between a main reflector and a shade. In the vehicular illumination lamp described in "Patent Document 2," light from a light source is reflected downward by the first sub reflector disposed above an optical axis and forwardly of the main reflector and then reflected by the second sub reflector disposed below the optical axis so that the reflected light is incident on a projection lens.

[Patent Document 1] Japanese Patent Application Laid-Open (Kokai) No. 2005-166590

[Patent Document 2] Japanese Patent Application Laid-Open (Kokai) No. 2007-329068

SUMMARY OF INVENTION

In the vehicular illumination lamp described in "Patent Document 1" described above, the luminous flux utilization factor for light from the light-emitting element can be enhanced with part of reflected light from the main reflector reflected upward by the upward reflective surface of the mirror member to be incident on the projection lens.

In the vehicular illumination lamp equipped with such a minor member, however, the reflected light from the main reflector is incident on areas of the projection lens both above and below the optical axis, and thus it is difficult to cut away a substantial portion of the projection lens to significantly reduce the size of the projection lens.

Thus, if it is attempted, in a vehicle equipped with such a vehicular illumination lamp, to lower the design lines of the surface of an upper portion of a front end portion of the vehicle body, the design lines may interfere with the projection lens of the vehicular illumination lamp or a support member for the projection lens, and therefore the freedom of the design lines of the vehicle may not be enhanced.

In this respect, also in the vehicular illumination lamp described in "Patent Document 2" described above, the reflected light from the main reflector and the reflected light sequentially reflected by the first and second sub reflectors is incident on areas of the projection lens both above and below the optical axis, and thus a similar situation occurs.

One or more embodiments of the present invention provide a projector-type vehicular illumination lamp that includes a light-emitting element serving as a light source and that can enhance the freedom of the design lines of the vehicle while securing a sufficient luminous flux utilization factor for light from the light-emitting element.

One or more embodiments of the present invention elaborate the configuration of a projection lens and a shade.

That is, in one or more embodiments of the present invention, a vehicular illumination lamp is provided including a projection lens disposed on an optical axis extending in a vehicular longitudinal direction, a light-emitting element disposed rearwardly of a rear-side focal point of the projection lens to be directed upward, a main reflector disposed to cover the light-emitting element from an upper side to reflect light from the light-emitting element toward the projection lens, and a shade disposed with an upper end edge thereof passing closely below the rear-side focal point to block part of reflected light from the main reflector, wherein generally the entirety of a portion of the projection lens that is positioned above the optical axis is cut away, a downward reflective surface that reflects downward the reflected light from the main reflector is formed on a rear surface of the shade, and a sub reflector that reflects forward the reflected light from the main reflector reflected by the downward reflective surface of the shade so as not to be incident on the projection lens is disposed below the shade.

The term "light-emitting element" means a light source provided in the form of an element and having a light-emitting chip that performs surface emission in a generally dot-like area. The type of the "light-emitting element" is not specifically limited. The position of the "light-emitting element" is not specifically limited as long as the "light-emitting element" is disposed rearwardly of the rear-side focal point of the projection lens to be directed upward. The "light-emitting element" is not necessarily disposed to be directed vertically upward.

The shape and size of the "projection lens" are not specifically limited as long as generally the entirety of a portion of the "projection lens" that is positioned above the optical axis has been cut away. The term "generally the entirety" means a range that is 5 mm or more above the optical axis.

Given the above configuration, the vehicular illumination lamp according to one or more embodiments of the present invention is formed as a projector-type vehicular illumination lamp including a light-emitting element serving as a light source, in which generally the entirety of a portion of the projection lens that is positioned above the optical axis is cut away, the downward reflective surface which reflects downward the reflected light from the main reflector is formed on the rear surface of the shade, and the sub reflector which reflects forward the reflected light from the main reflector reflected by the downward reflective surface of the shade so as not to be incident on the projection lens is disposed below the shade. Thus, the following effect can be obtained.

That is, in the vehicular illumination lamp according to one or more embodiments of the present invention, generally the entirety of a portion of the projection lens that is positioned above the optical axis is cut away, and thus the front end portion of the vehicular illumination lamp can be lowered in height compared to the vehicular illumination lamp according to the related art. Thus, in a vehicle to which the vehicular illumination lamp is to be mounted, the design lines of the surface of an upper portion of a front end portion of the vehicle body can be lowered by an amount corresponding to generally the upper half of the projection lens, which has been cut away, compared to the vehicular illumination lamp according to the related art, thereby enhancing the freedom of the design lines of the vehicle.

In the vehicular illumination lamp according to one or more embodiments of the present invention, unlike the vehicular illumination lamp according to the related art, no mirror member is provided, and thus no light is reflected by a mirror member to be directed toward a portion of the projection lens that is positioned above the optical axis. Thus, no obstacle is presented in terms of optics if generally the entirety of such a portion has been cut away.

In the vehicular illumination lamp according to one or more embodiments of the present invention, meanwhile, the reflected light from the main reflector reflected by the downward reflective surface of the shade is reflected forward by the sub reflector disposed below the shade. Thus, the reflected light from the main reflector, which is reflected upward by a mirror member to be utilized in the vehicular illumination lamp according to the related art, can still be utilized. The sub reflector is configured to reflect the reflected light so as not to be incident on the projection lens, and thus the reflected light is not affected by whether or not the projection lens has been cut away. Thus, even though generally the upper half of the projection lens has been cut away, the luminous flux utilization factor for light from the light-emitting element can be maintained at generally the same level as that for the vehicular illumination lamp according to the related art which includes a mirror member.

According to one or more embodiments of the present invention, as has been described above, in the projector-type vehicular illumination lamp which includes the light-emitting element serving as a light source, the freedom of the design lines of the vehicle can be enhanced while securing a sufficient luminous flux utilization factor for light from the light-emitting element.

In one or more embodiments, the main reflector may be formed with an extended portion that extends obliquely downward and forward from a front end edge of the main reflector to the proximity of an upper end surface of the projection lens, and a downward reflective surface that reflects the light from the light-emitting element toward the sub reflector may be formed on a lower surface of the extended portion. According to such a configuration, the luminous flux utilization factor for light from the light-emitting element can be further enhanced.

In one or more embodiments, the downward reflective surface of the shade may be configured to converge the reflected light from the main reflector reflected by the downward reflective surface of the shade on a predetermined point between the shade and the sub reflector in a vertical plane including the optical axis, and the downward reflective surface of the extended portion of the main reflector may be configured to converge the light from the light-emitting element reflected by the downward reflective surface of the extended portion of the main reflector on the predetermined point in the vertical plane including the optical axis. According to such a configuration, reflection of the reflected light from the downward reflective surface of the shade and of the reflected light from the downward reflective surface of the extended portion of the main reflector by the sub reflector can be controlled precisely.

In this case, each of the downward reflective surfaces may be or may not be configured such that light reflected by portions of the downward reflective surfaces that are not positioned in the vertical plane including the optical axis is converged on the predetermined point.

Other aspects and advantages of the invention will be apparent from the following description, the drawings and the claims.

DETAILED DESCRIPTION

Hereinafter, embodiments of a vehicular illumination lamp according to the present invention will be described with reference to accompanying drawings.

Figure 1:
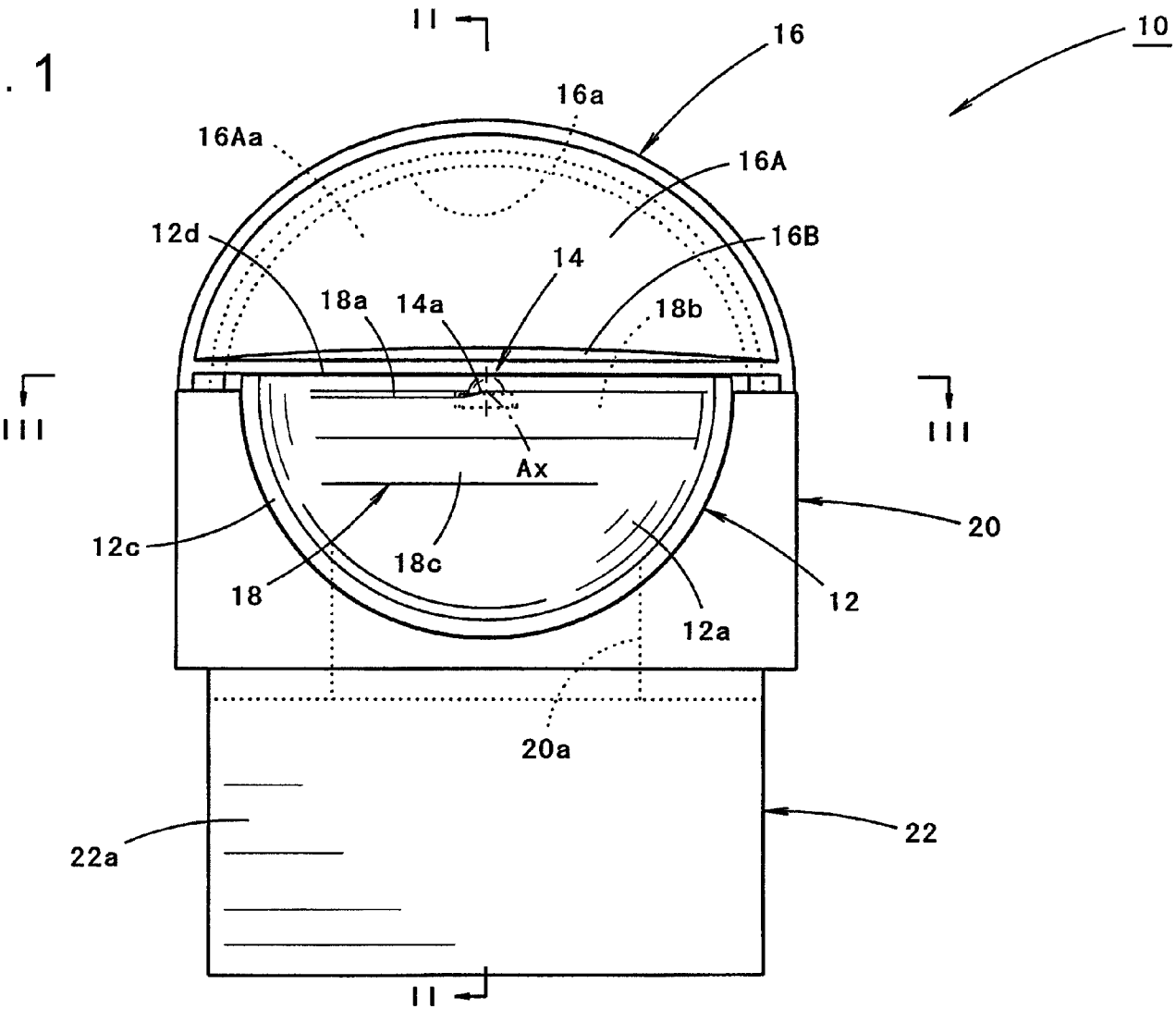
FIG. 1 is a front view showing a vehicular illumination lamp according to an embodiment of the present invention.
Figure 2:
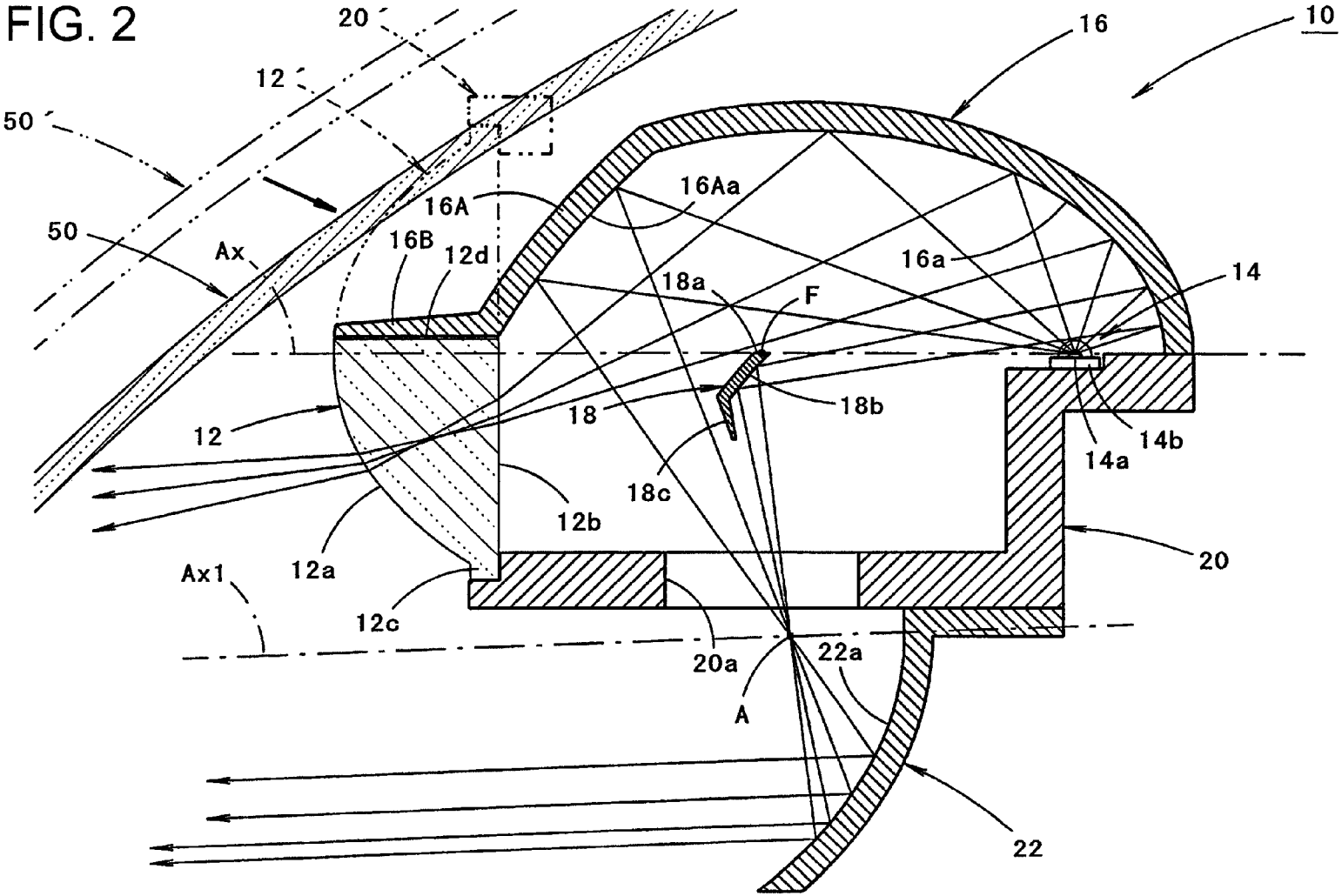
FIG. 2 is a II-II cross-sectional view of FIG. 1.
Figure 3:
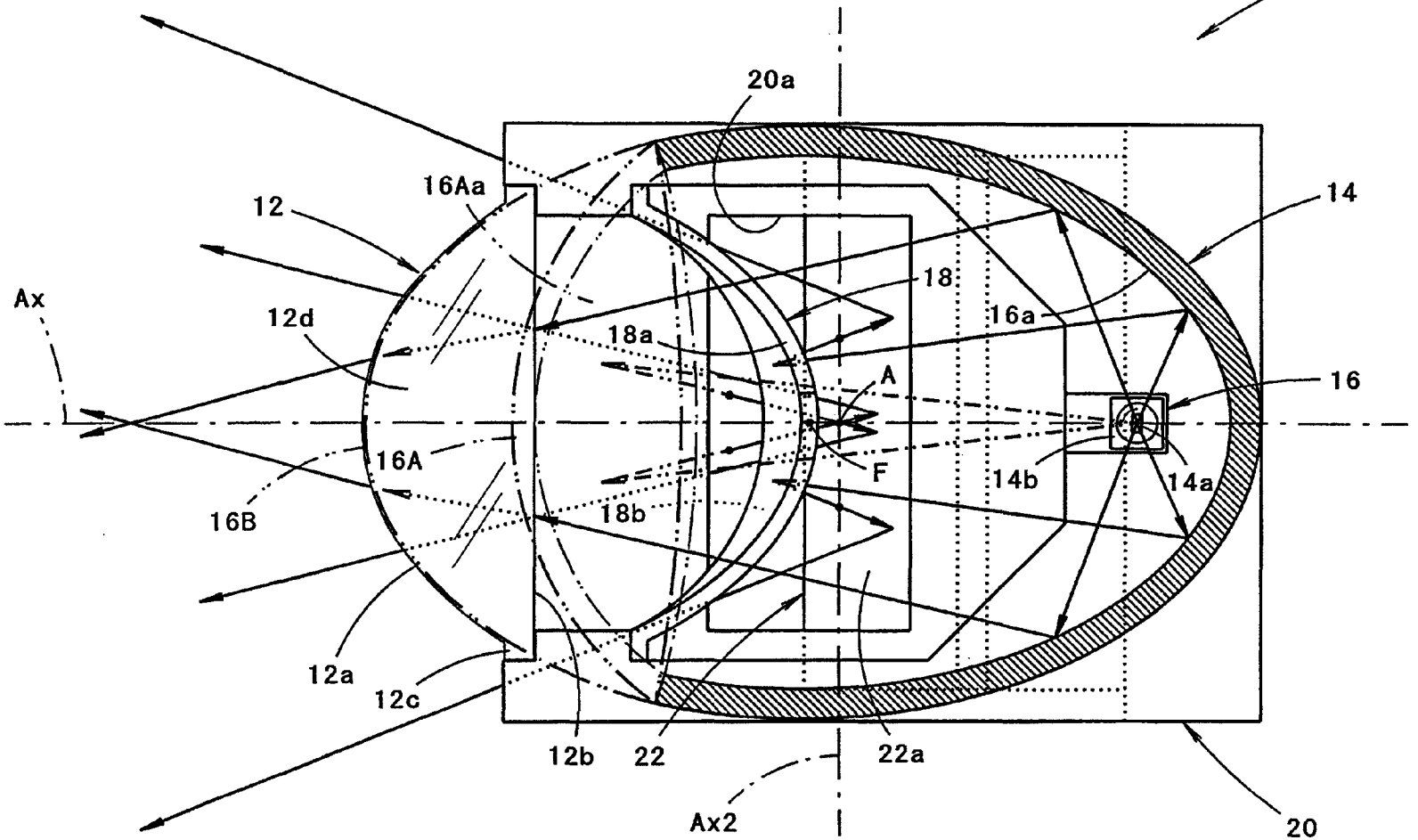
FIG. 3 is a III-III cross-sectional view of FIG. 1.

FIG. 1 is a front view showing a vehicular illumination lamp 10 according to an embodiment of the present invention. FIGS. 2 and 3 are a II-II cross-sectional view and a III-III cross-sectional view, respectively, of FIG. 1.

As shown in the drawings, the vehicular illumination lamp 10 is formed as a projector-type lamp unit that emits light to form a low-beam light distribution pattern, and is used as it is tiltably supported by a lamp body (not shown) or the like to serve as a part of a headlamp.

The vehicular illumination lamp 10 includes a projection lens 12 disposed on an optical axis Ax extending in a vehicular longitudinal direction, a light-emitting element 14 disposed rearwardly of a rear-side focal point F of the projection lens 12, a main reflector 16 that reflects light from the light-emitting element 14 toward the projection lens 12, a shade 18 that blocks part of reflected light from the main reflector 16, a sub reflector 22, and a holder 20 that supports these components.

When mounted as a part of a headlamp, the vehicular illumination lamp 10 is disposed such that the optical axis Ax extends downward by about 0.5 to 0.6° with respect to the vehicular longitudinal direction.

The headlamp to which the vehicular illumination lamp 10 is mounted includes a translucent cover 50 inclined upward toward the rear along the design line of the surface of an upper portion of a front end portion of the vehicle body.

The projection lens 12 is a planoconvex aspherical lens with a convex front-side surface 12*a* and a flat rear-side surface 12*b*, and projects a light source image formed on the rear-side focal plane of the projection lens 12 (that is, a focal plane including the rear-side focal point F of the projection lens 12) onto a virtual vertical screen ahead of the lamp as an inverted image.

Generally the entirety of a portion of the projection lens 12 that is positioned above the optical axis Ax has been cut away. Specifically, the projection lens 12 has a generally semi-circular outer shape as viewed from the front of the lamp, with a flange portion 12*c* formed at a generally semi-circular outer peripheral edge portion of the projection lens 12. An upper end surface 12*d* of the projection lens 12 is formed as a horizontal surface. The upper end surface 12*d* is positioned 0 to 5 mm (for example, about 2.5 mm) above the optical axis Ax.

The light-emitting element 14 is a white light-emitting diode 14, and includes a light-emitting chip 14*a* having a rectangular light-emitting surface and a substrate 14*b* that supports the light-emitting chip 14*a*. The light-emitting element 14 is fixed to the holder 20 with the light-emitting surface of the light-emitting chip 14*a* directed vertically upward on the optical axis Ax. The main reflector 16 has a generally semi-dome shape to cover the light-emitting chip 14*a* from the upper side, and the lower end edge of the main reflector 16 is fixed to the holder 20.

A reflective surface 16*a* of the main reflector 16 is formed by a generally ellipsoidal curved surface with the major axis coaxial with the optical axis Ax and with the first focal point at the center of light emission by the light-emitting chip 14*a*, and with the eccentricity becoming gradually larger from a vertical cross section toward a horizontal cross section. The reflective surface 16*a* is configured to generally converge light from the light-emitting chip 14*a* on a position forwardly of and slightly below the rear-side focal point F of the projection lens 12 in a vertical cross section and on a position further ahead in a horizontal cross section.

The main reflector 16 is formed such that the front end edge of the reflective surface 16*a* is positioned forwardly of the rear-side focal point F of the projection lens 12. The main reflector 16 is formed with an extended portion 16A (which will be discussed later) that extends obliquely downward and forward from the front end edge of the main reflector 16 to the proximity of the upper end surface 12*d* of the projection lens 12.

The main reflector 16 is further formed with a visor portion 16B that extends along the upper end surface 12*d* of the projection lens 12 from the front end edge of the extended portion 16A to the proximity of the front-side surface 12*a* of the projection lens 12. The projection lens 12 is fixed to the holder 20 through the flange portion 12*c*, and fixed to the visor portion 16B of the main reflector 16 through the upper end surface 12*d*.

The shade 18 is disposed such that an upper end edge 18*a* of the shade 18 passes through the rear-side focal point F. The upper end edge 18*a* is formed to be curved forward from the position on the optical axis Ax toward both the left and right sides. A left portion of the upper end edge 18*a* that is positioned on the left side with respect to the optical axis Ax extends in a horizontal plane including the optical axis Ax, and a right portion of the upper end edge 18*a* that is positioned on the right side with respect to the optical axis Ax extends in a horizontal plane that is one step lower than the left portion via a short inclined portion. The shade 18 is fixed to the holder 20 through both left and right end portions of the shade 18.

A downward reflective surface 18*b* that reflects downward the light from the light-emitting chip 14*a* reflected by the reflective surface 16*a* of the main reflector 16 is formed on the rear surface of the shade 18. The downward reflective surface 18*b* is configured to converge the reflected light from the main reflector 16 reflected by the downward reflective surface 18*b* on a predetermined point A between the shade 18 and the sub reflector 22 in a vertical plane including the optical axis Ax.

The shade 18 is further formed with a downward extended portion 18*c* that extends further downward from the lower end edge of the downward reflective surface 18*b*. The thus formed downward extended portion 18*c* prevents the reflected light from the main reflector 16 from passing closely below the downward reflective surface 18*b* to be incident on the projection lens 12.

A downward reflective surface 16Aa that reflects the light from the light-emitting chip 14*a* toward the sub reflector 22 is formed on the lower surface of the extended portion 16A of the main reflector 16. The downward reflective surface 16Aa is configured to converge the light from the light-emitting chip 14*a* reflected by the downward reflective surface 16Aa on the predetermined point A in the vertical plane including the optical axis Ax. The downward reflective surface 16Aa is configured to cause the reflected light from the downward reflective surface 16Aa to pass through the front of the shade 18 and converge on the predetermined point A.

The sub reflector 22 has a reflective surface 22*a* configured such that the cross-sectional shape of the reflective surface 22*a* taken along the vertical plane including the optical axis Ax forms a parabola with the focal point at the predetermined point A and with the axis being an axis line Ax1 extending forward and slightly downward with respect to the optical axis Ax. In the sub reflector 22, the reflective surface 22*a* reflects forward the light reflected by each of the downward reflective surface 18*b* of the shade 18 and the downward reflective surface 16Aa of the extended portion 16A to be temporarily converged on the predetermined point A and then be diverged from the predetermined point A into generally parallel light in the vertical direction so as not to be incident on the projection lens 12 (specifically, so as to pass below the projection lens 12). The sub reflector 22 is fixed to the holder 20 through an upper end portion of the sub reflector 22.

The holder 20 is formed with an open portion 20*a* such that the reflected light from each of the downward reflective surface 18*b* of the shade 18 and the downward reflective surface 16Aa of the extended portion 16A is not blocked.

The downward reflective surface 16Aa of the extended portion 16A is formed in an ellipsoidal shape such that light from the light-emitting chip 14*a* reflected by portions of the downward reflective surface 16Aa that are not positioned in the vertical plane including the optical axis Ax is also converged on the predetermined point A.

The downward reflective surface 18*b* of the shade 18 is formed in a generally inverted conical surface shape in correspondence with the upper end edge 18*a* of the shade 18 which is formed to be curved forward toward both the left and right sides. Consequently, the downward reflective surface 18*b* reflects the reflected light from the main reflector 16 in a direction more away from the optical axis Ax, as viewed in plan, as the reflected light is reflected by a portion of the downward reflective surface 18*b* that is farther away from the vertical plane including the optical axis Ax. The downward reflective surface 18*b* is shaped such that the reflected light from portions of the downward reflective surface 18*b* that are not positioned in the vertical plane including the optical axis Ax is converged on an axis line Ax2 passing through the predetermined point A and extending horizontally in the lateral direction.

The downward extended portion 18*c* of the shade 18 is formed to extend from the lower end edge of the downward reflective surface 18*b* toward the axis line Ax2 so as to block the reflected light from the downward reflective surface 18*b* of the shade 18 and the reflected light from the downward reflective surface 16Aa of the extended portion 16A as little as possible.

The reflective surface 22*a* of the sub reflector 22 is formed in a parabolic cylindrical surface shape with the focal line being the axis line Ax2. Consequently, the reflective surface 22*a* reflects the reflected light from the downward reflective surface 18*b* of the shade 18 into light that is widely diffused to both the left and right sides in the horizontal direction, and also reflects the reflected light from the downward reflective surface 16Aa of the extended portion 16A into light that is more or less widely diffused to both the left and right sides in the horizontal direction.

Figure 4:
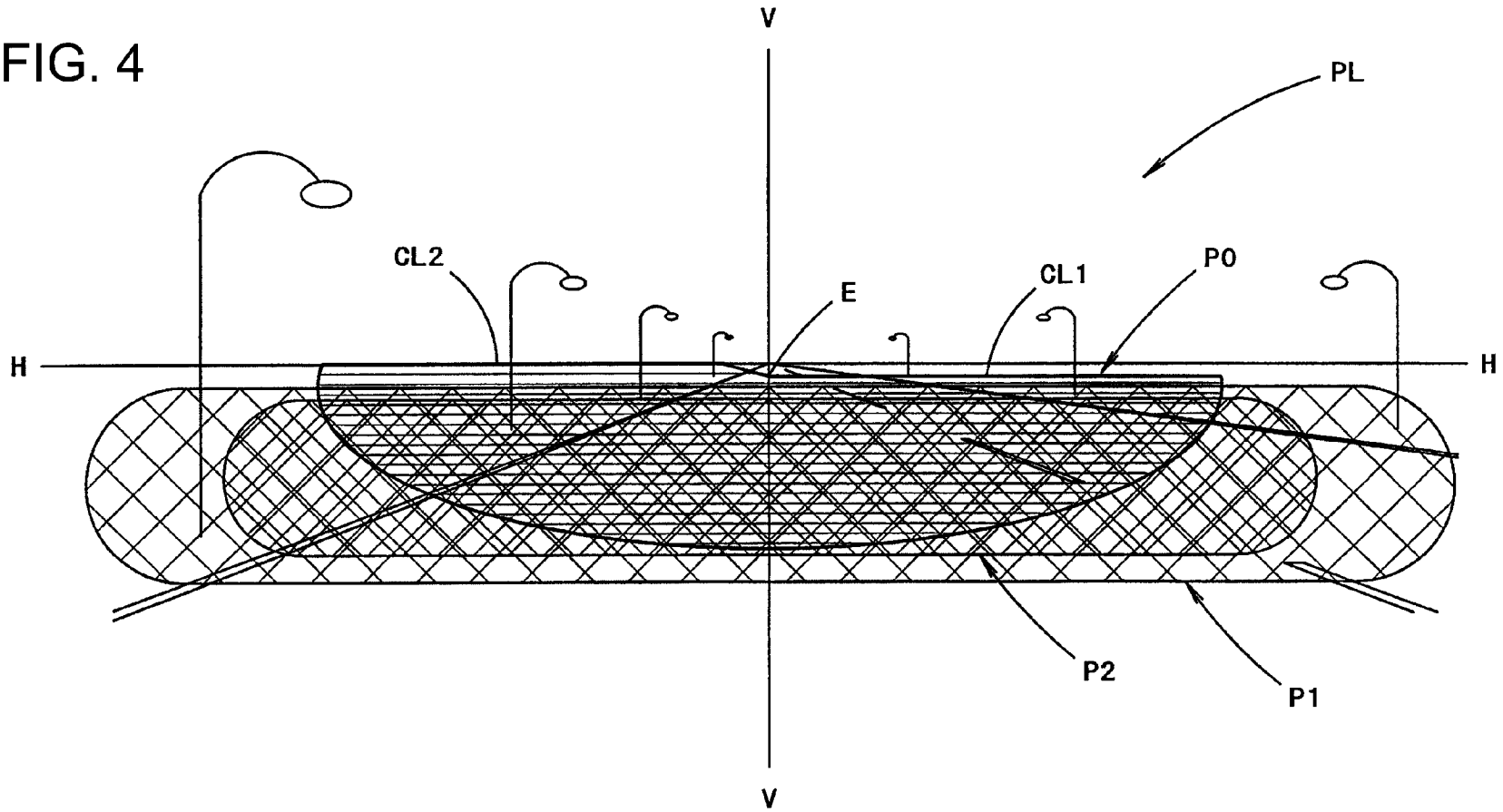
FIG. 4 shows a low-beam light distribution pattern to be formed on a virtual vertical screen disposed at a distance of 25 meters (m) ahead of the vehicular illumination lamp by light emitted forward from the lamp.

FIG. 4 perspectively shows a low-beam light distribution pattern PL to be formed on a virtual vertical screen disposed at a distance of 25 meters (m) ahead of the vehicle by light emitted forward from the vehicular illumination lamp 10.

As shown in the drawing, the low-beam light distribution pattern PL is a low-beam light distribution pattern for left side light distribution, and has laterally asymmetrical cut-off lines CL1, CL2 at an upper end edge of the low-beam light distribution pattern.

The low-beam light distribution pattern PL is formed as a synthesized light distribution pattern including a basic light distribution pattern P0, a first additional light distribution pattern P1, and a second additional light distribution pattern P2.

The basic light distribution pattern P0 is a light distribution pattern formed by light from the light-emitting chip 14*a* reflected by the reflective surface 16*a* of the main reflector 16 and then radiated forward via the projection lens 12.

The basic light distribution pattern P0 is a light distribution pattern forming the basic shape of the low-beam light distribution pattern PL, and the cut-off lines CL1, CL2 are formed in the basic light distribution pattern P0.

The cut-off lines CL1, CL2 extend laterally asymmetrically in the horizontal direction with a V-V line, which is a vertical line passing through a point H-V as the vanishing point in the forward direction of the lamp, serving as the boundary between the cut-off lines CL1, CL2. The cut-off line CL1 on the oncoming lane side is formed to extend in the horizontal direction on the right side with respect to the V-V line, and the cut-off line CL2 on the side of the lane in which the host vehicle is located is formed to extend in the horizontal direction on the left side with respect to the V-V line at a step above the cut-off line CL1 on the oncoming lane side.

In the basic light distribution pattern P0, an elbow point E, which is the intersection between the lower-step cut-off line CL1 and the V-V line, is positioned about 0.5 to 0.6° below the point H-V. This is because the optical axis Ax extends downward by about 0.5 to 0.6° with respect to the vehicular longitudinal direction.

The basic light distribution pattern P0 is formed by having an image of the light-emitting chip 14*a*, which is formed by the light from the light-emitting chip 14*a* reflected by the main reflector on the plane of the rear-side focal point of the projection lens 12, projected on the virtual vertical screen through the projection lens 12 as an inverted projection image. The cut-off lines CL1, CL2 of the basic light distribution pattern P0 are formed as an inverted projection image of the upper end edge 18*a* of the shade 18.

The additional light distribution pattern P1 is a light distribution pattern formed by light from the light-emitting chip 14*a* sequentially reflected by the reflective surface 16*a* of the main reflector 16, the downward reflective surface 18*b* of the shade 18, and the reflective surface 22*a* of the sub reflector 22 and then radiated forward not via the projection lens 12.

The additional light distribution pattern P1 is formed below the cut-off lines CL1, CL2 as a horizontally long light distribution pattern that extends toward both the left and right sides into a thin shape while partially overlapping the basic light distribution pattern P0. The upper end edge of the additional light distribution pattern P1 is positioned closely below the cut-off lines CL1, CL2. The additional light distribution pattern P1 has a lateral diffusion angle that is larger than that of the basic light distribution pattern P0.

The additional light distribution pattern P1 is formed as a horizontally long light distribution pattern because the reflective surface 22*a* of the sub reflector 22 is formed in a parabolic cylindrical surface shape with the focal line being the axis line Ax2 which passes through the predetermined point A.

The additional light distribution pattern P2 is a light distribution pattern formed by light from the light-emitting chip 14*a* sequentially reflected by the reflective surface 16Aa of the extended portion 16A of the main reflector 16 and the reflective surface 22*a* of the sub reflector 22 and then radiated forward not via the projection lens 12.

The additional light distribution pattern P2 is also formed below the cut-off lines CL1, CL2 as a horizontally long light distribution pattern that extends toward both the left and right sides into a thin shape while partially overlapping the basic light distribution pattern P0, as with the additional light distribution pattern P1. The upper end edge of the additional light distribution pattern P2 is also positioned closely below the cut-off lines CL1, CL2. However, the additional light distribution pattern P2 is formed as a light distribution pattern with a slightly small vertical width and a slightly small lateral diffusion angle compared to those of the additional light distribution pattern P1.

The additional light distribution pattern P2 is formed as a horizontally long light distribution pattern because the reflective surface 22*a* of the sub reflector 22 is formed in a parabolic cylindrical surface shape with the focal line being the axis line Ax2 which passes through the predetermined point A. In addition, the additional light distribution pattern P2 is formed to have a vertical width that is smaller than that of the additional light distribution pattern P1 because the reflective surface 16Aa of the extended portion 16A of the main reflector 16 is positioned farther away from the light-emitting chip 14*a* than the downward reflective surface 18*b* of the shade 18.

With the additional light distribution patterns P1, P2 overlapped with the basic light distribution pattern P0, the low-beam light distribution pattern PL irradiates the road surface ahead of the vehicle evenly from a close area to a far area.

As has been discussed in detail above, the vehicular illumination lamp 10 according to the embodiment is formed as a projector-type vehicular illumination lamp including the light-emitting element 14 serving as a light source, in which generally the entirety of a portion of the projection lens 12 that is positioned above the optical axis Ax has been cut away, the downward reflective surface 18*b* which reflects downward the reflected light from the main reflector 16 is formed on the rear surface of the shade 18, and the sub reflector 22 which reflects forward the reflected light from the main reflector 16 reflected by the downward reflective surface 18*b* so as not to be incident on the projection lens 12 is disposed below the shade 18. Thus, the following effect can be obtained.

That is, in the vehicular illumination lamp 10 according to one or more embodiments, generally the entirety of a portion of the projection lens 12 that is positioned above the optical axis Ax has been cut away, and thus the front end portion of the vehicular illumination lamp 10 can be lowered in height compared to the vehicular illumination lamp according to the related art.

Specifically, as indicated by two-dotted broken lines in FIG. 2, if a projection lens 12' for the vehicular illumination lamp according to the related art is disposed in place of the projection lens 12 according to one or more embodiments, for example, it is necessary that a translucent cover 50' for a headlamp should be disposed at a position more or less away from the projection lens 12' obliquely upward and forward in order to avoid interference between the projection lens 12' and a holder 20' that supports the projection lens 12'.

In the vehicular illumination lamp 10 according to one or more embodiments, in contrast, the projection lens 12 has a shape obtained by cutting away generally the upper half of the projection lens 12' according to the related art, and thus the translucent cover 50 for a headlamp may be displaced more or less obliquely downward and rearward compared to the translucent cover 50' according to the related art without causing interference between the projection lens 12 and the visor portion 16B of the main reflector 16 which supports the projection lens 12.

Thus, in a vehicle to which the vehicular illumination lamp 10 is to be mounted, the design lines of the surface of an upper portion of a front end portion of the vehicle body can be lowered by an amount corresponding to generally the upper half of the projection lens 12, which has been cut away, compared to the vehicular illumination lamp according to the related art, thereby enhancing the freedom of the design lines of the vehicle.

In the vehicular illumination lamp 10 according to one or more embodiments, unlike the vehicular illumination lamp according to the related art, no mirror member is provided, and thus no light is reflected by a mirror member to be directed toward a portion of the projection lens 12 that is positioned above the optical axis Ax. Thus, no obstacle is presented in terms of optics if generally the entirety of such a portion has been cut away.

In the vehicular illumination lamp 10 according to one or more embodiments, meanwhile, the reflected light from the main reflector 16 reflected by the downward reflective surface 18*b* of the shade 18 is reflected forward by the sub reflector 22 disposed below the shade 18. Thus, the reflected light from the main reflector 16, which is reflected upward by a mirror member to be utilized in the vehicular illumination lamp according to the related art, can still be utilized. The sub reflector 22 is configured to reflect the reflected light so as not to be incident on the projection lens 12, and thus the reflected light is not affected by whether or not the projection lens 12 has been cut away. Thus, even though generally the upper half of the projection lens 12 has been cut away, the luminous flux utilization factor for light from the light-emitting element 14 can be maintained at generally the same level as that for the vehicular illumination lamp according to the related art which includes a mirror member.

According to one or more embodiments, as has been described above, in the projector-type vehicular illumination lamp 10 which includes the light-emitting element 14 serving as a light source, the freedom of the design lines of the vehicle can be enhanced while securing a sufficient luminous flux utilization factor for light from the light-emitting element 14.

In one or more embodiments, in addition, the main reflector 16 is formed with the extended portion 16A which extends obliquely downward and forward from the front end edge of the main reflector 16 to the proximity of the upper end surface 12*d* of the projection lens 12, and the downward reflective surface 16Aa which reflects the light from the light-emitting element 14 toward the sub reflector 22 is formed on the lower surface of the extended portion 16A. Thus, the luminous flux utilization factor for light from the light-emitting element 14 can be further enhanced.

The downward reflective surface 18*b* of the shade 18 is configured to converge the reflected light from the main reflector 16 reflected by the downward reflective surface 18*b* on the predetermined point A between the shade 18 and the sub reflector 22 in the vertical plane including the optical axis Ax. In addition, the downward reflective surface 16Aa of the extended portion 16A of the main reflector 16 is configured to converge the light from the light-emitting element 14 reflected by the downward reflective surface 16Aa on the predetermined point A in the vertical plane including the optical axis Ax. Thus, reflection of the reflected light from the downward reflective surface 18*b* of the shade 18 and of the reflected light from the downward reflective surface 16Aa of the extended portion 16A of the main reflector 16 by the sub reflector 22 can be controlled precisely.

In one or more embodiments, as described above, the downward reflective surface 18*b* of the shade 18 is formed in a generally inverted conical surface shape in correspondence with the upper end edge 18*a* of the shade 18 which is formed to be curved forward toward both the left and right sides. However, it is also possible to adopt other configurations (such as a configuration in which the upper end edge 18*a* of the shade 18 extends straight toward both the left and right sides and correspondingly the downward reflective surface 18*b* of the shade 18 extends straight in the lateral direction, for example).

In one or more embodiments, as described above, the reflective surface 22*a* of the sub reflector 22 is formed in a parabolic cylindrical surface shape. However, it is also possible to adopt other configurations (such as a configuration in which a reflective element for lateral diffusion is formed on a paraboloid of revolution, for example).

While the vehicular illumination lamp 10 is configured to form a low-beam light distribution pattern for left side light distribution as the low-beam light distribution pattern PL in the embodiments described above, a low-beam distribution pattern for right side light distribution may also be formed using the same configuration as that according to the embodiments described above to achieve the same effect as that obtained in the embodiments described above.

The numerical values provided as specifications in the embodiments described above are merely exemplary, and it is a matter of course that different values may be used appropriately.

While description has been made in connection with exemplary embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

[Description of the Reference Numerals]

10 VEHICULAR ILLUMINATION LAMP
12 PROJECTION LENS
12*a* FRONT-SIDE SURFACE
12*b* REAR-SIDE SURFACE
12*c* FLANGE PORTION
12*d* UPPER END SURFACE
14 LIGHT-EMITTING ELEMENT
14*a* LIGHT-EMITTING CHIP
14*b* SUBSTRATE
16 MAIN REFLECTOR
16*a* REFLECTIVE SURFACE
16A EXTENDED PORTION
16Aa DOWNWARD REFLECTIVE SURFACE
16B VISOR PORTION
18 SHADE
18*a* UPPER END EDGE
18*b* DOWNWARD REFLECTIVE SURFACE
18*c* DOWNWARD EXTENDED PORTION
20 HOLDER
20*a* OPEN PORTION

22 SUB REFLECTOR
22*a* REFLECTIVE SURFACE
50 TRANSLUCENT COVER
A PREDETERMINED POINT
Ax OPTICAL AXIS
Ax1, Ax2 AXIS LINE
CL, CL2 CUT-OFF LINE
E ELBOW POINT
F REAR-SIDE FOCAL POINT
PL LOW-BEAM LIGHT DISTRIBUTION PATTERN
P0 BASIC LIGHT DISTRIBUTION PATTERN
P1 FIRST ADDITIONAL LIGHT DISTRIBUTION PATTERN
P2 SECOND ADDITIONAL LIGHT DISTRIBUTION PATTERN

What is claimed is:

1. A vehicular illumination lamp comprising:

a projection lens disposed on an optical axis extending in a vehicular longitudinal direction, a light-emitting element disposed rearwardly of a rear-side focal point of the projection lens to be directed upward, a main reflector disposed to cover the light-emitting element from an upper side to reflect light from the light-emitting element toward the projection lens, a shade disposed with an upper end edge thereof passing closely below the rear-side focal point to block part of reflected light from the main reflector, and a sub reflector disposed below the shade, wherein most of the projection lens positioned above the optical axis is cut away, wherein a downward reflective surface that reflects downward the reflected light from the main reflector is formed on a rear surface of the shade, and wherein the sub reflector reflects forward the reflected light from the main reflector reflected by the downward reflective surface of the shade so as not to be incident on the projection lens.

2. The vehicular illumination lamp according to claim 1, wherein the main reflector is formed with an extended portion that extends obliquely downward and forward from a front end edge of the main reflector to the proximity of an upper end surface of the projection lens, and wherein a downward reflective surface that reflects the light from the light-emitting element toward the sub reflector is formed on a lower surface of the extended portion.

3. The vehicular illumination lamp according to claim 2, wherein the downward reflective surface of the shade is configured to converge the reflected light from the main reflector reflected by the downward reflective surface of the shade on a predetermined point between the shade and the sub reflector in a vertical plane including the optical axis, and wherein the downward reflective surface of the extended portion is configured to converge the light from the light-emitting element reflected by the downward reflective surface of the extended portion on the predetermined point in the vertical plane including the optical axis.

4. A method of manufacturing a vehicular illumination lamp comprising:

disposing a projection lens on an optical axis extending in a vehicular longitudinal direction, disposing a light-emitting element rearwardly of a rear-side focal point of the projection lens to be directed upward, disposing a main reflector to cover the light-emitting element from an upper side to reflect light from the light-emitting element toward the projection lens, disposing a shade with an upper end edge thereof passing closely below the rear-side focal point to block part of reflected light from the main reflector, and disposing a sub reflector below the shade, wherein most of the projection lens positioned above the optical axis is cut away, wherein a downward reflective surface that reflects downward the reflected light from the main reflector is formed on a rear surface of the shade, and wherein the sub reflector reflects forward the reflected light from the main reflector reflected by the downward reflective surface of the shade so as not to be incident on the projection lens.

5. The method according to claim 4, wherein the main reflector is formed with an extended portion that extends obliquely downward and forward from a front end edge of the main reflector to the proximity of an upper end surface of the projection lens, and wherein a downward reflective surface that reflects the light from the light-emitting element toward the sub reflector is formed on a lower surface of the extended portion.

6. The method according to claim 5, wherein the downward reflective surface of the shade is configured to converge the reflected light from the main reflector reflected by the downward reflective surface of the shade on a predetermined point between the shade and the sub reflector in a vertical plane including the optical axis, and wherein the downward reflective surface of the extended portion is configured to converge the light from the light-emitting element reflected by the downward reflective surface of the extended portion on the predetermined point in the vertical plane including the optical axis.

* * * * *